US008118108B2

(12) United States Patent
Medina

(10) Patent No.: US 8,118,108 B2
(45) Date of Patent: Feb. 21, 2012

(54) COMBUSTION PROCESS STOPPER

(76) Inventor: Juan Manuel Medina, Tijuana (MX)

( * ) Notice: Subject to any disclaimer, the term of this patent is extended or adjusted under 35 U.S.C. 154(b) by 548 days.

(21) Appl. No.: 12/080,617

(22) Filed: Apr. 4, 2008

(65) Prior Publication Data

US 2009/0139736 A1 Jun. 4, 2009

Related U.S. Application Data

(60) Provisional application No. 61/005,306, filed on Dec. 3, 2007.

(51) Int. Cl.
*A62C 8/00* (2006.01)

(52) U.S. Cl. ..... 169/50; 169/53

(58) Field of Classification Search ..... 169/48, 169/49, 50–53, 68
See application file for complete search history.

(56) References Cited

U.S. PATENT DOCUMENTS 2,044,687 A * 6/1936 Hatten ..... 169/50
3,049,389 A * 8/1962 Chappellier ..... 312/324
3,209,837 A * 10/1965 Freedman ..... 169/42
3,687,185 A * 8/1972 Singer ..... 160/1
4,344,489 A 8/1982 Bonaparte
4,776,403 A 10/1988 Lejosne
4,986,363 A 1/1991 Nahmiaj
5,331,956 A * 7/1994 Bailey ..... 128/202.13
5,549,259 A 8/1996 Herlik
5,626,194 A 5/1997 White
5,944,114 A 8/1999 Farley
6,076,608 A * 6/2000 MacDonald et al. ..... 169/16
6,189,622 B1 * 2/2001 Audet et al. ..... 169/37
7,089,862 B1 8/2006 Vasquez
7,131,679 B1 11/2006 Teran
7,261,165 B1 8/2007 Black
7,275,529 B2 10/2007 Boys
7,284,727 B2 10/2007 Nolan
7,337,156 B2 2/2008 Wippich

* cited by examiner

*Primary Examiner* — Davis Hwu

(57) ABSTRACT

A fire extinguishing apparatus in which one embodiment comprises of a dome lengthening into an extendable and flexible cylinder which contains a device that can adapt and form a seal with the surface as it is lowered, by means of a lifting device, on to a fire below, encapsulating said fire and extinguishing it by striving it of oxygen. The apparatus can be stretched or collapsed by means of installed winches, to accommodate different sizes of burning materials and to facilitate transportation.

2 Claims, 20 Drawing Sheets

COMBUSTION PROCESS STOPPER

CROSS REFERENCE TO RELATED APPLICATIONS

This application claims the benefit of provisional patent application Ser. No. 61/005,306, filed 2007 Dec. 3 by the same inventor.

FEDERALLY SPONSORED RESEARCH

Not applicable

SEQUENCE LISTING OR PROGRAM

Not applicable

BACKGROUND

1. Field of Invention

This invention relates to fire extinguishing, in particular extinguishing forest fires.

2. Prior Art

In resent history, wildfire and forest fires have become difficult phenomenon to control and an economical strain, both for the loss in property such as homes and forest, but also on resources and environmental impact.

The efficiency of forest fire fighting techniques has remained the same for many years, in particular dropping water or chemicals over the fire by means of an aircraft. A mayor disadvantage of this method is the need to leave the firefighting area to reload the water or chemicals after they have been released, wasting valuable time.

Other methods used are those of back burning and firebreaks. The back burning method is performed by setting fires in strategically planned areas, but runs the danger of getting out of control and provoking yet, another wildfire. Firebreaks are a method of removing combustible materials from the path of the fire, therefore preventing the fire from advancing. Firebreaks usually require a lot of personnel and equipment, but can be hindered by irregular terrain and can be dangerous to personnel.

The objective of this invention is to fight fires by mechanical means eliminating the need to carry water or chemicals (such as fire retardants) to the fire fighting site. Furthermore, by eliminating the use of chemicals, money is saved and additionally, more time is dedicated to the actual fighting of fires since no time is wasted in having to leave the area to recharge the aircraft with chemicals or water. A longer continuity fighting fires is accomplished since the helicopter carrying the invention will be limited by its own fuel consumption. Moreover, less ground personnel will be utilized fighting the fire, therefore exposing firefighters to less danger.

Since the invention can be carried by helicopter to the fire sight, it can be utilized in any type of terrain and fight fires in an aggressive and direct technique by actually submerging in to the fire.

The invention, combustion process stopper (CPS), in its main embodiment can be fabricated in different sizes, as illustrated in FIG. 6, to accommodate the different types of fires as well as different types of geographical region characteristic (difference in type of terrain, forest density, size of trees, etc.). Also by having a small CPS, as in FIG. 6C, it can be mobilized in a rapid manner to start combating the fires, while the bigger CPS's are readied. In addition, the CPS is not limited to only forest fires, but can be used in different types of fires, i.e., in the correct size and configuration, it can be used to put out an oil well fire.

SUMMARY

One embodiment of the combustion process stopper comprises of a main cavity to encapsulate the fire and strive it of oxygen, accommodating its self to any type of terrain and forming a seal with the ground.

DRAWINGS—FIGURES

In the drawings, closely related figures have the same number.

DRAWINGS—REFERENCE NUMERALS

Figure 1:
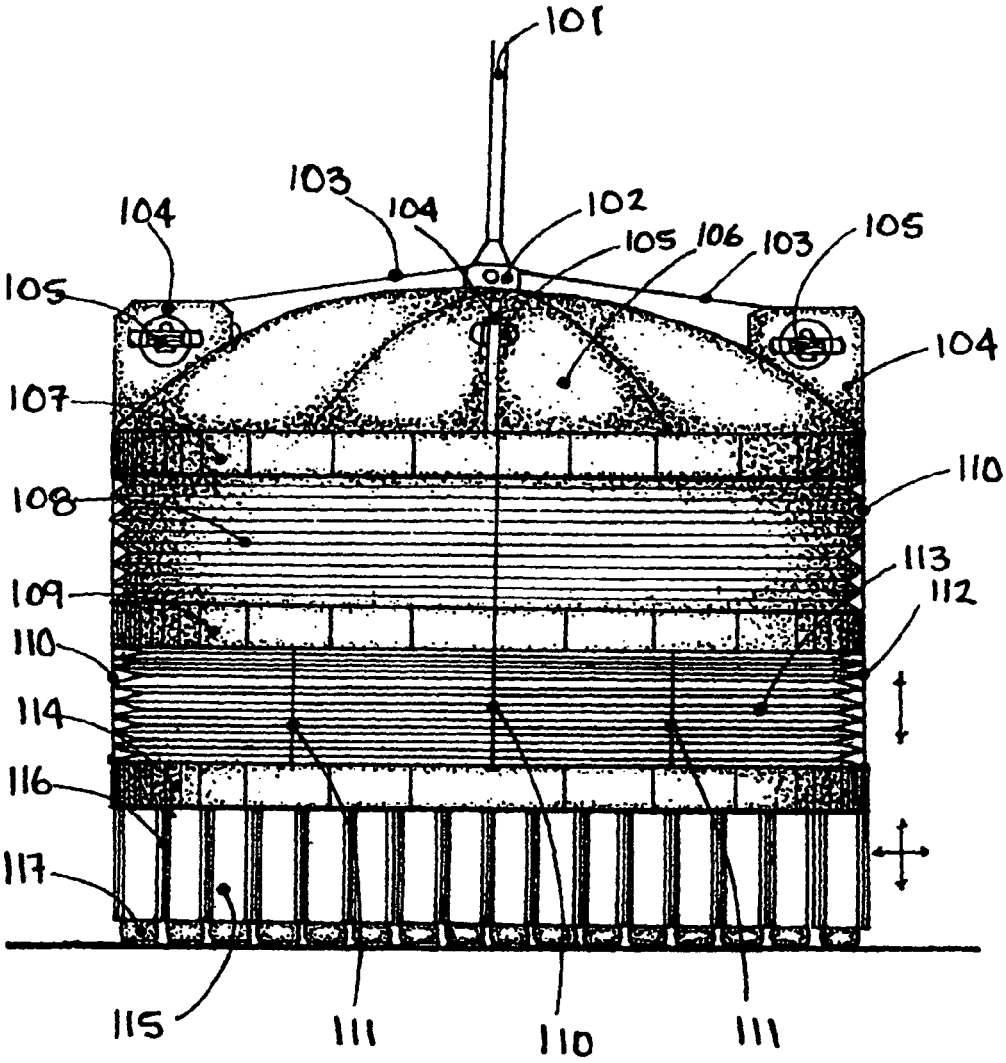
FIG. 1 shows a front view of the embodiment in the collapsed position.

101 lifting device
102 load coupling attachment
103 stabilizing tensor cables
104 winch mounting and stabilizing brackets
105 extending and collapsing winches
106 exterior dome panels
107 upper circular truss cover
108 middle outer cover
109 middle circular truss cover
110 winch cables

111 limiting chains
112 pivoting unions
113 fire resistant fabric bellows
114 lower circular truss cover
115 outer sealing fabric sections
116 inner sealing fabric sections
117 sealing weights
118 vertical beam supporters
119 fire proof panels
120 fabric attaching metal rings
121 supporting ring
122 upper circular truss
123 middle circular truss
124 lower circular truss
125 cable end connector
126 primary beam horizontal support
127 cable end attachment
128 electrical connections
130 secondary beam vertical connector
129 primary beams
131 secondary horizontal support
132 secondary beams
133 chain supporting bracket
134 primary beam vertical connector
135 pulley
136 sealing weigh supporting chain
137 structural member
138 cable guide
139 winch base

DETAIL DESCRIPTION—FIGS. 1 THROUGH 24—PREFERRED EMBODIMENT

Figure 2:
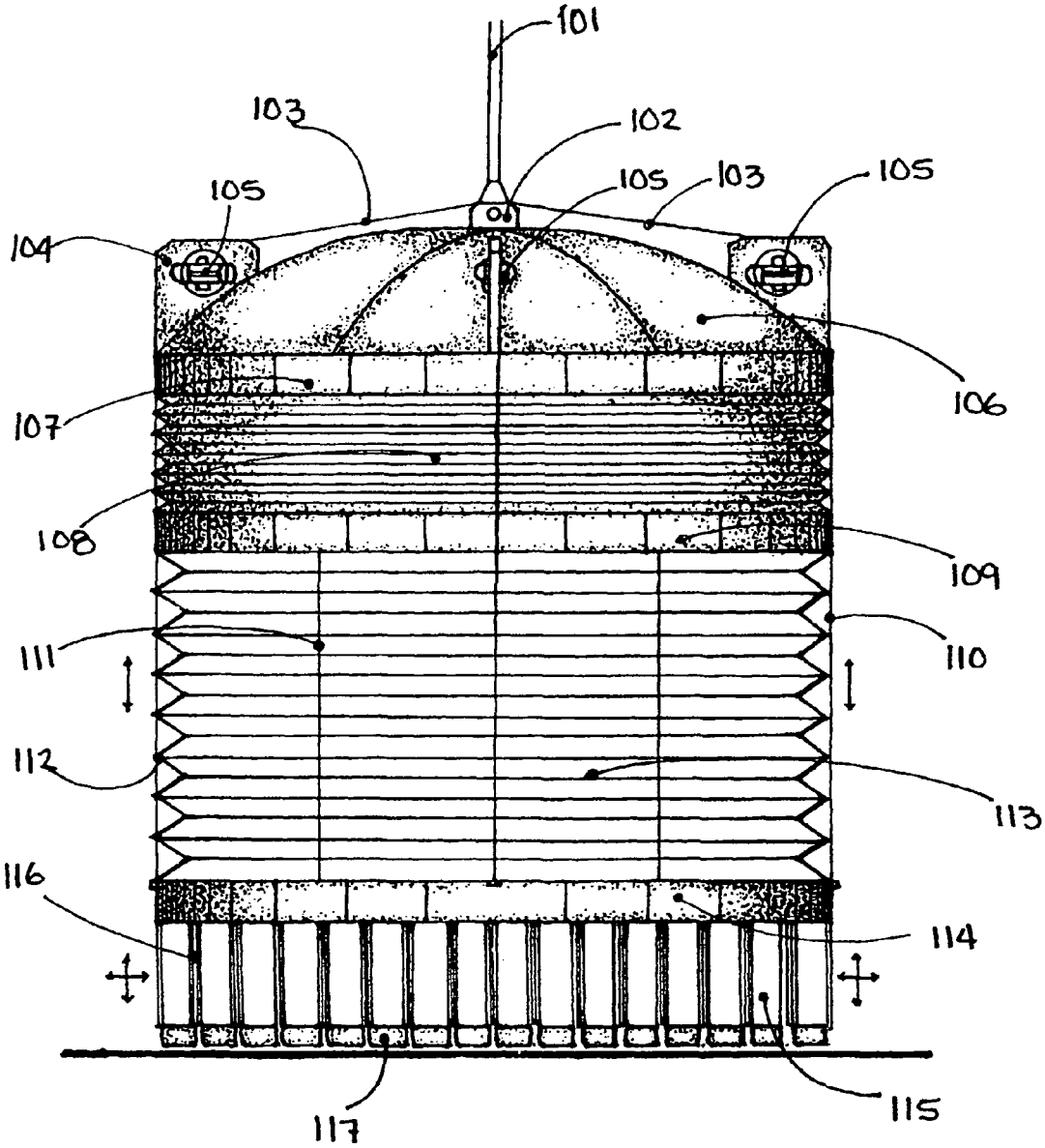
FIG. 2 shows front view of the embodiment in its extended position.
Figure 3:
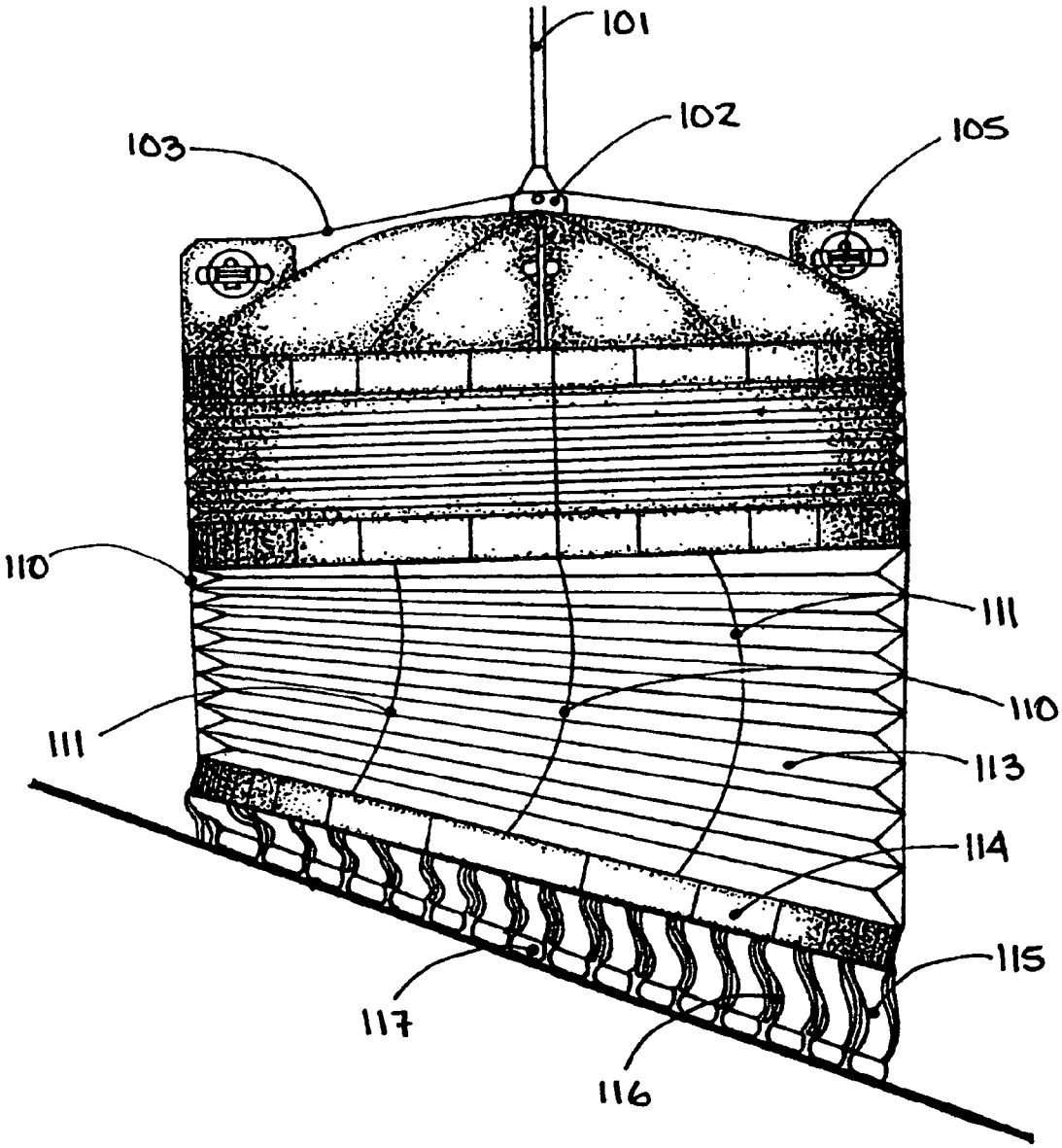
FIG. 3 shows front view of the embodiment rested in an inclined terrain.
Figure 4:
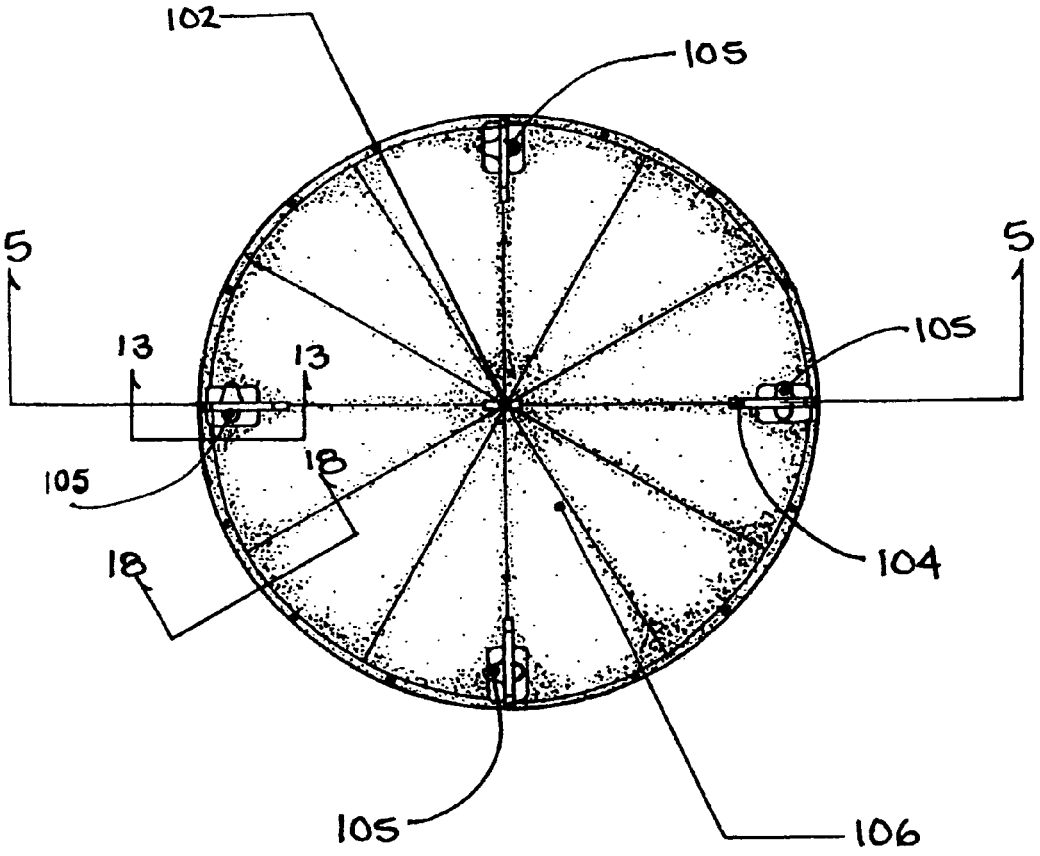
FIG. 4 shows top view of the embodiment illustrating sections for FIG. 5, FIG. 13, and FIG. 18.

FIG. 1 (front view), FIG. 2 (front view extended), FIG. 3 (front view in incline), and FIG. 4 (top view) show illustrations of one embodiment of the Combustion Process Stopper (CPS). The CPS is lifted though a lifting device 101 (helicopter, crane, etc.) connected to a load coupling attachment 102. The load coupling attachment 102 is welded to a structural member 137 (FIG. 10), said structural member 137 is welded to supporting ring 121.

Furthermore the CPS is comprised of a dome covered with a plurality of exterior dome panels 106 on which a plurality of winch mounting and stabilizing brackets 104 are attached and an extending and collapsing winches 105 are mounted. A plurality of stabilizing tensor cables 103 are attached between the winch mounting and stabilizing brackets 104 and the coupling attachment 102.

Additionally, upper circular truss cover 107, middle outer cover 108, middle circular truss cover 109, and lower circular truss cover 114 are shown with lifting and lowering winch cables 110 and a plurality of limiting chains 111.

The extending and collapsing portion of the CPS is comprised of a fire resistant fabric bellows 113, forming bellows comprised of pivoting unions 112.

Figure 24:
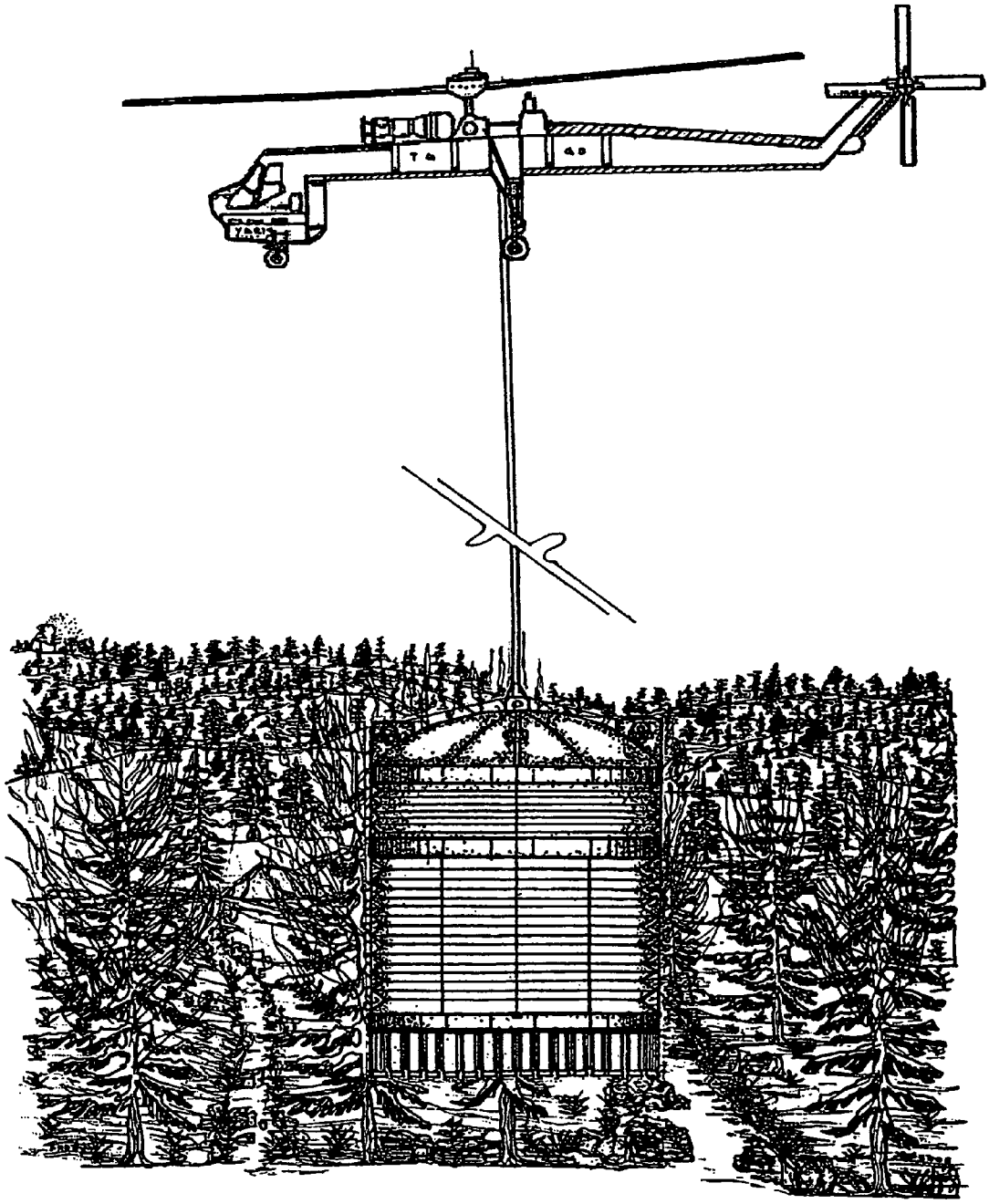
FIG. 24 illustrates one of the embodiments in use.

In the lower section of the CPS a fire proof outer sealing fabric sections 115 and a fire proof inner sealing fabric sections 116 are attached to a lower circular truss 124 (FIG. 24). Also shown is a plurality of the sealing weights 117.

Figure 5:
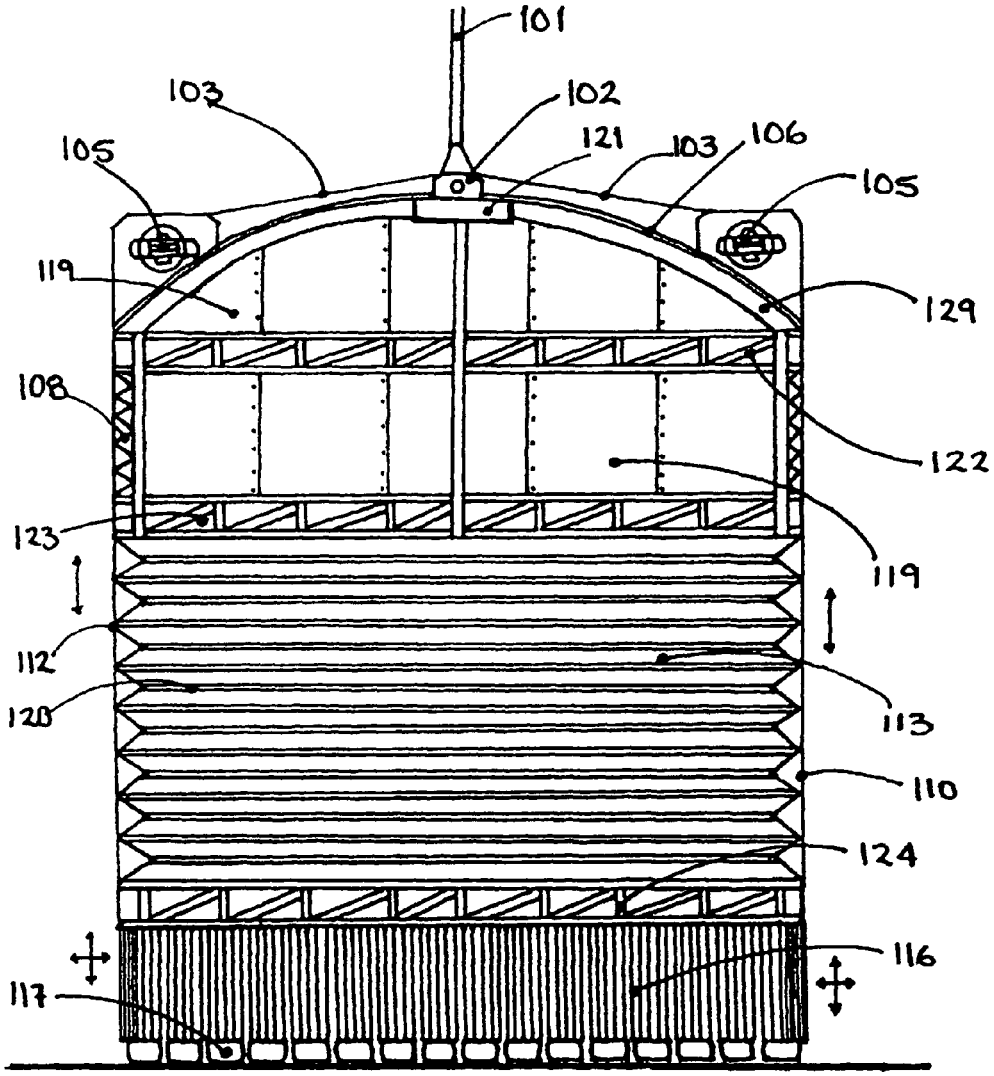
FIG. 5 shows cross section 5-5 (FIG. 4).
Figure 6:
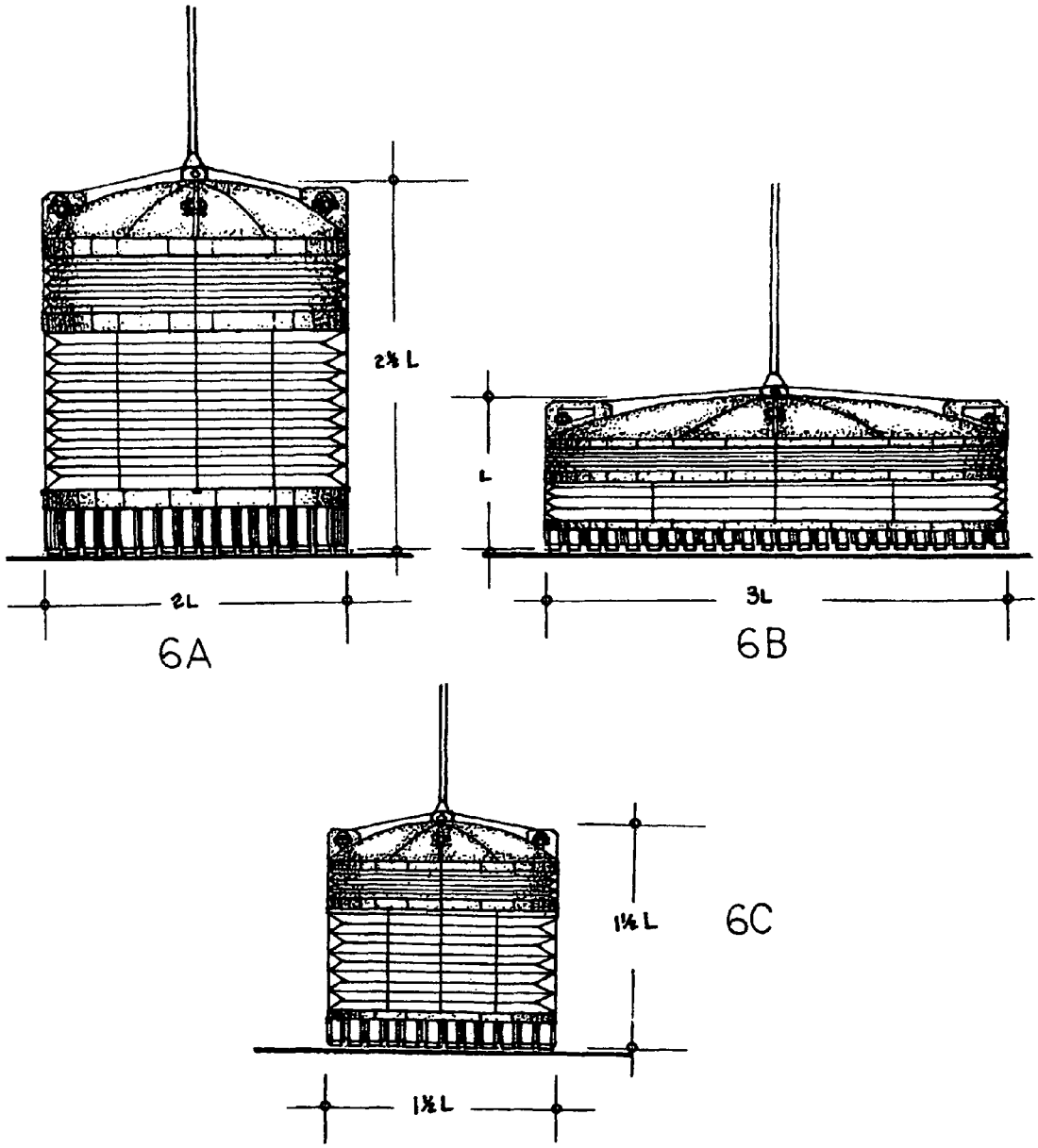
FIG. 6 shows different size configurations.

FIG. 5 shows a section marked on FIG. 4 as 5-5 and illustrates the interior parts of the embodiment. Shown are primary beams 129 connecting to the supporting ring 121 on one end. Said primary beams 129 extend down attaching an upper circular truss 122 and a middle circular truss 123. Attached to structure formed by the said primary beams 129, supporting ring 121, upper circular truss 122, and middle circular truss 123 are a plurality of inner fire proof panels 119 on the inside, and a plurality of the exterior dome panels 106 as well as the middle outer cover 108 on the outside of the structure.

Also shown on FIG. 5 is a plurality of fabric attaching metal rings 120 alternating in size to form the fire resistant fabric bellows 113. To the top of the said fire resistant fabric bellows 113 is fasten the middle circular truss 123, and the lower circular truss 124 on the bottom. Affixed to the said lower circular truss 124 are the inner sealing fabric sections 116 and the sealing weights 117.

Figure 7:
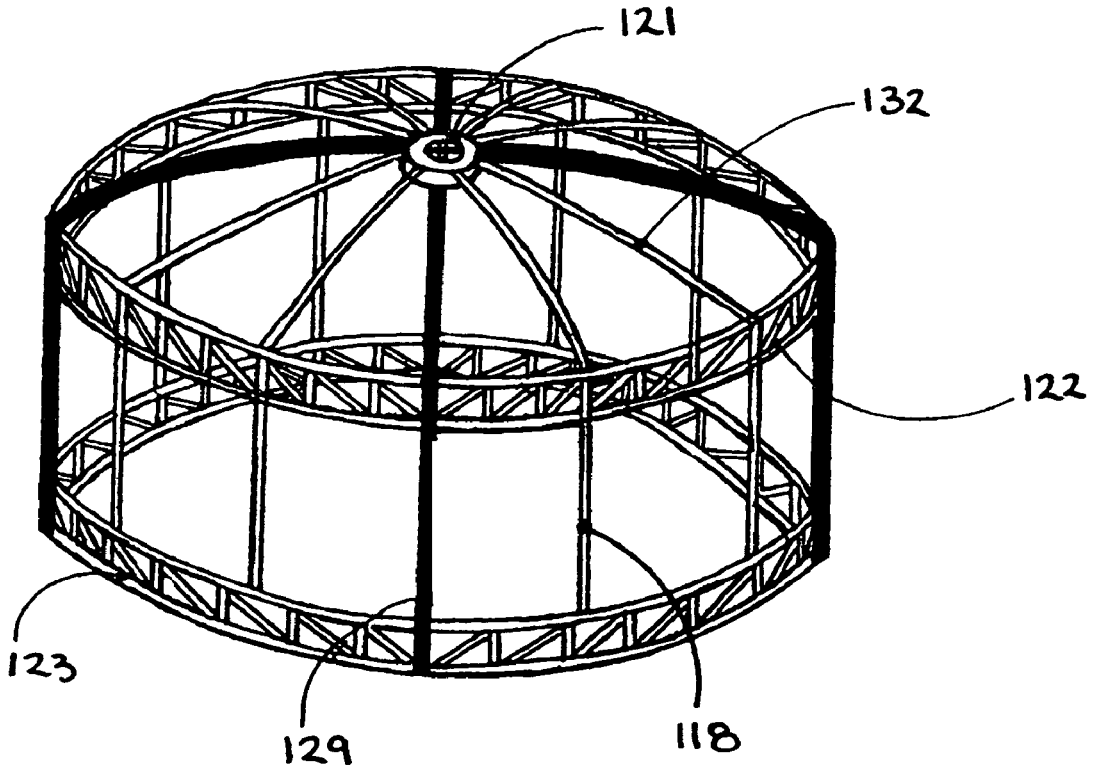
FIG. 7 shows an isometric view of the dome structure.

FIG. 7 is an isometric illustration of the dome structure showing the primary beams 129 which attach to the upper circular truss 122 and the middle circular truss 123, and affix to the center top at the supporting ring 121. Also attached to the supporting ring 121 is a plurality of secondary beams 132. The upper circular truss 122 and the middle circular truss 123 are reinforced by vertical beam supporters 118.

Figure 8:
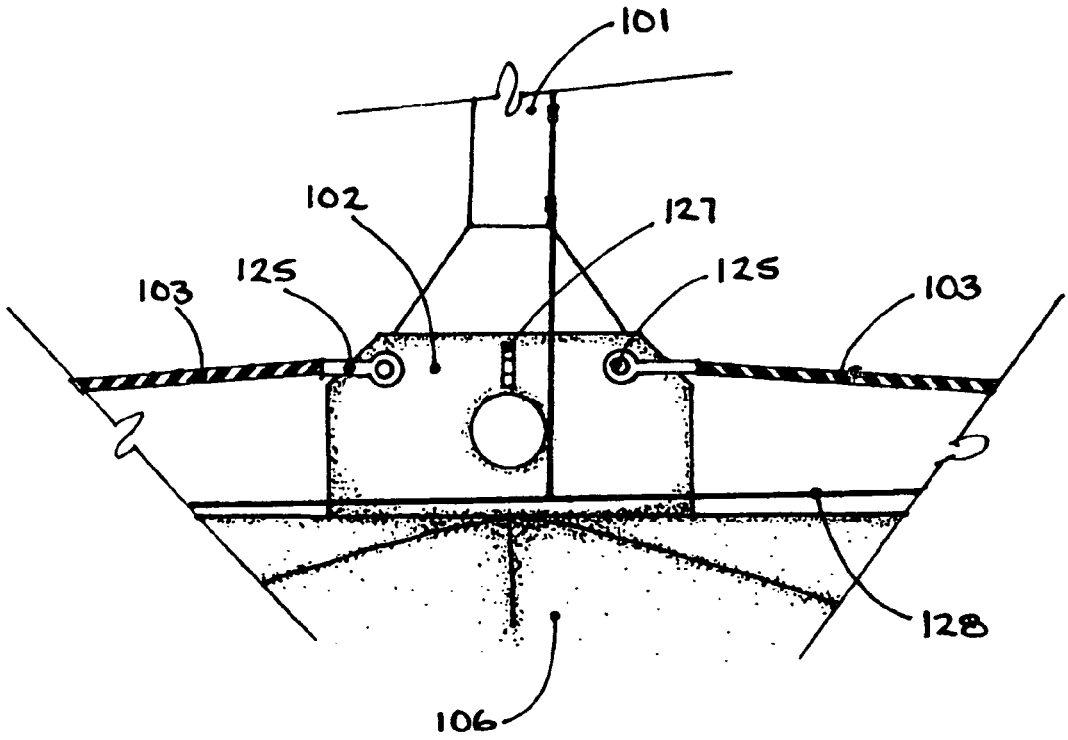
FIG. 8 shows detail of load coupling attachment.

FIG. 8 shows a detail of the load coupling attachment 102 and a cable end attachment 127 with attachment of stabilizing tensor cables 103 by the use of a cable end connector 125. Also illustrated are the electrical connections 128.

Figure 9:
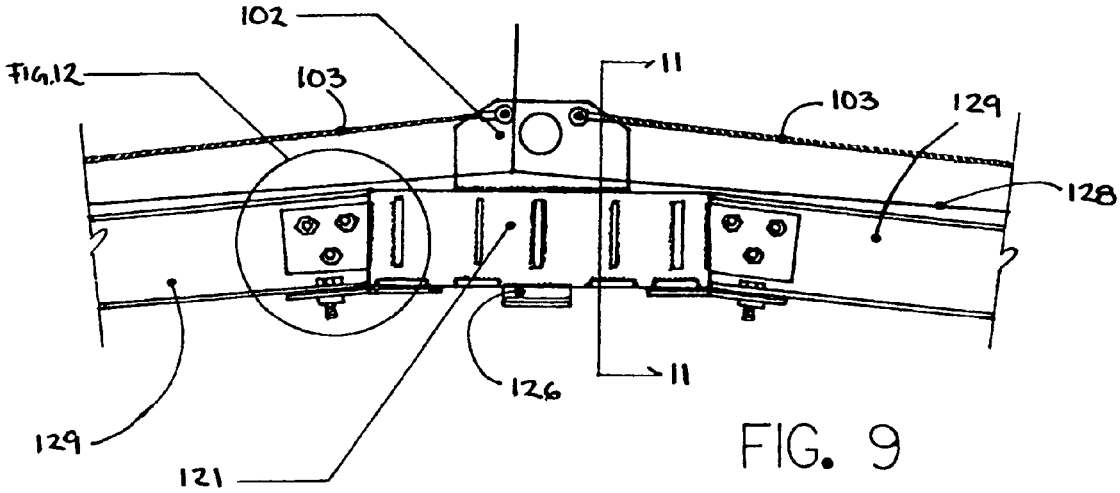
FIG. 9 shows detail of the supporting ring and attachment, showing section for FIG. 11.
Figure 10:
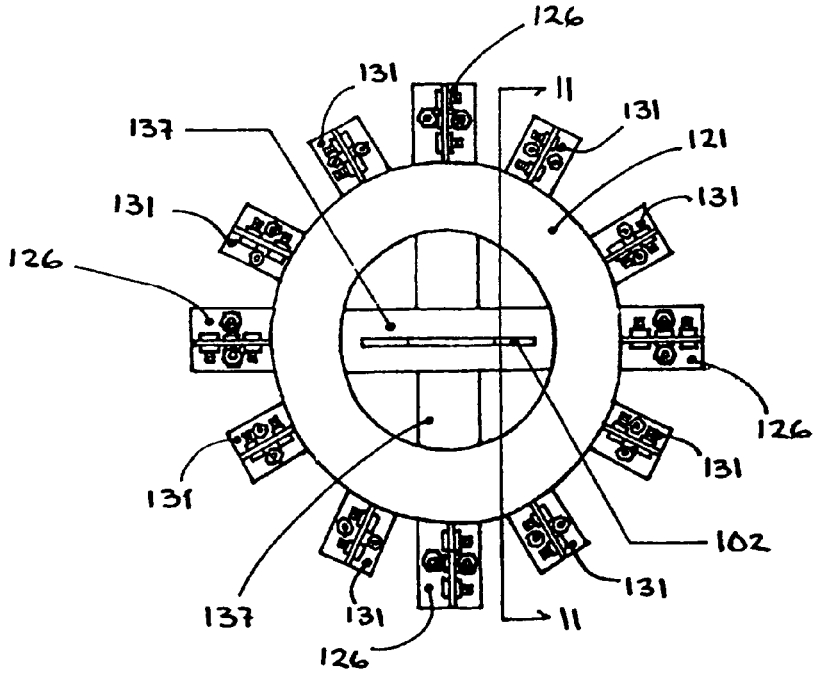
FIG. 10 shows top view of supporting ring and attachments, showing section for FIG. 11.

FIG. 9 and FIG. 10 is a detail of attachments of the primary beams 129 to the supporting ring 121 by use of a primary beam horizontal support 126. The secondary beams 132 are attached to the supporting ring 121 by a secondary beam horizontal support 131.

Figure 11:
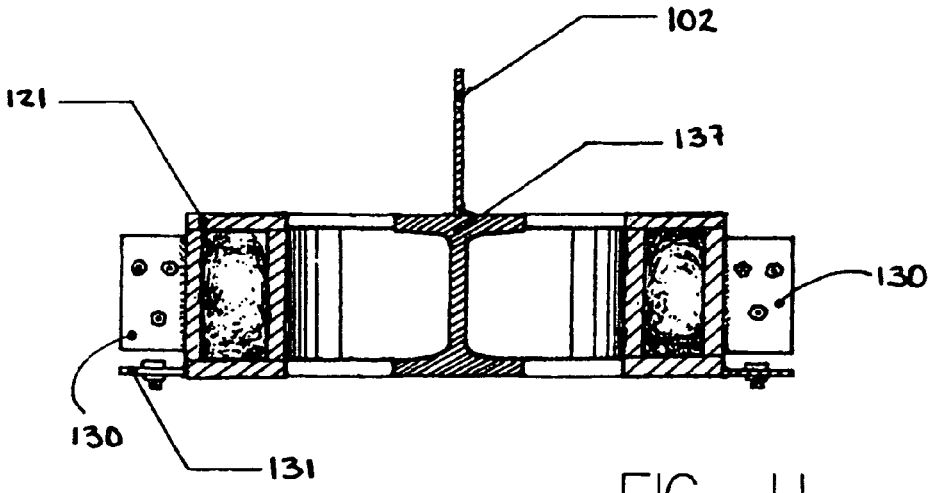
FIG. 11 shows cross section 11-11 (FIG. 9 and FIG. 10).

FIG. 11 illustrated cross section 11-11 shown on FIG. 10 and details the supporting ring 121 and structural member 137.

Figure 12:
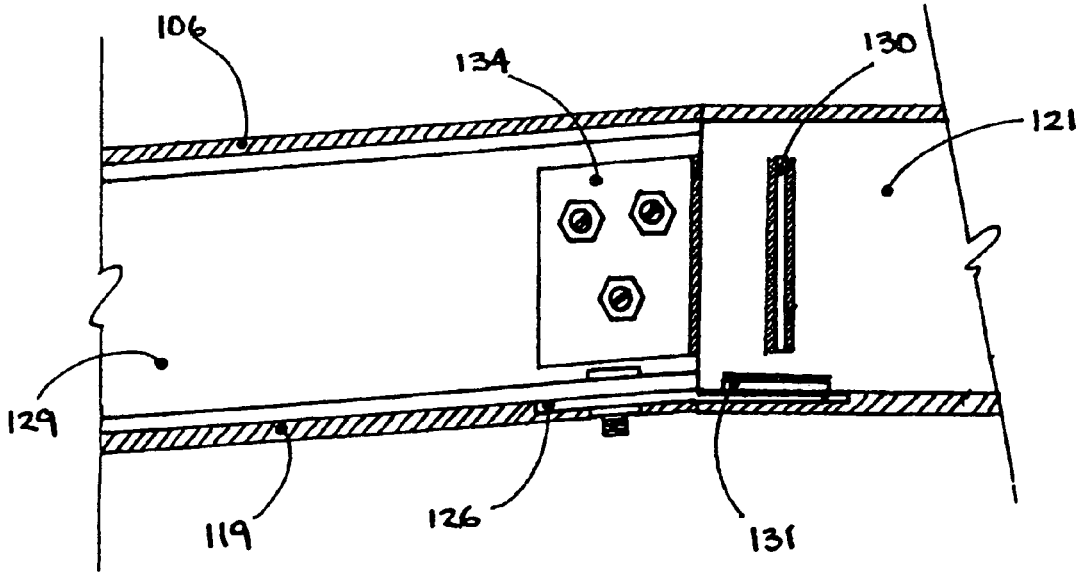
FIG. 12 shows detail of primary beam attachment.
Figure 13:
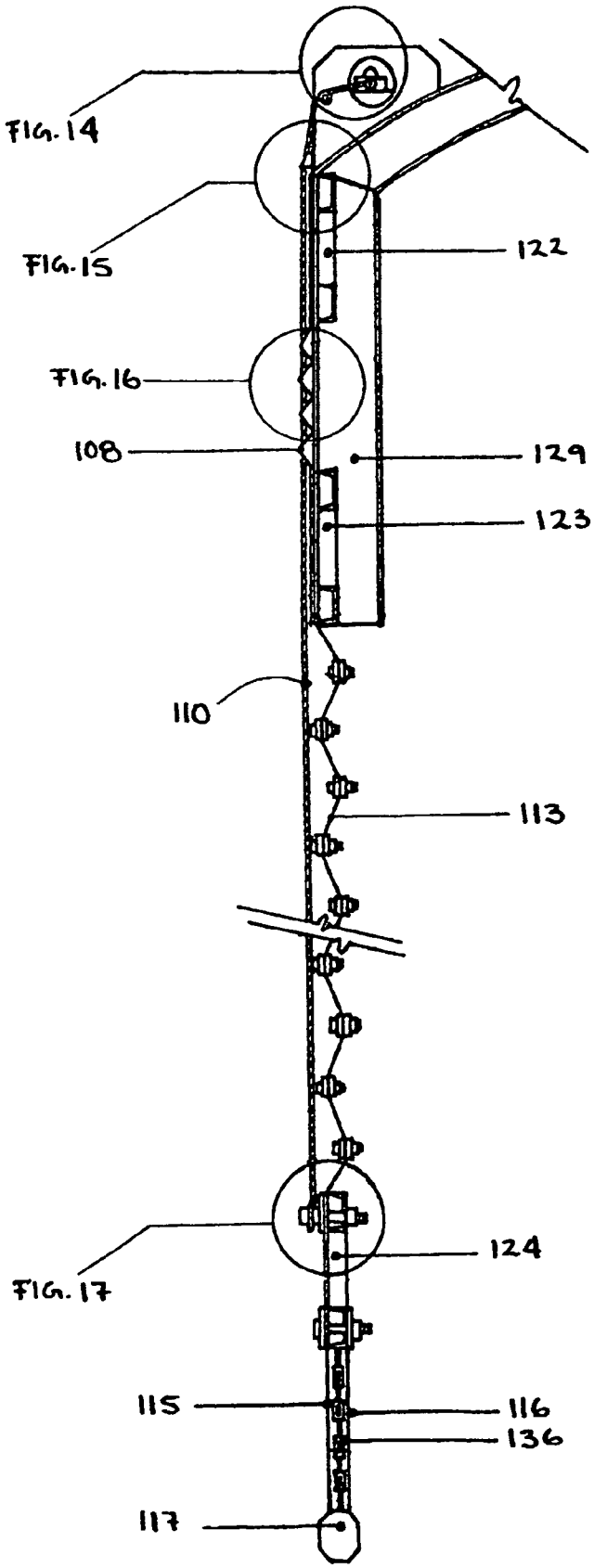
FIG. 13 shows cross section 13-13 (FIG. 4) at primary beam illustrating operation of winch cable.
Figure 14:
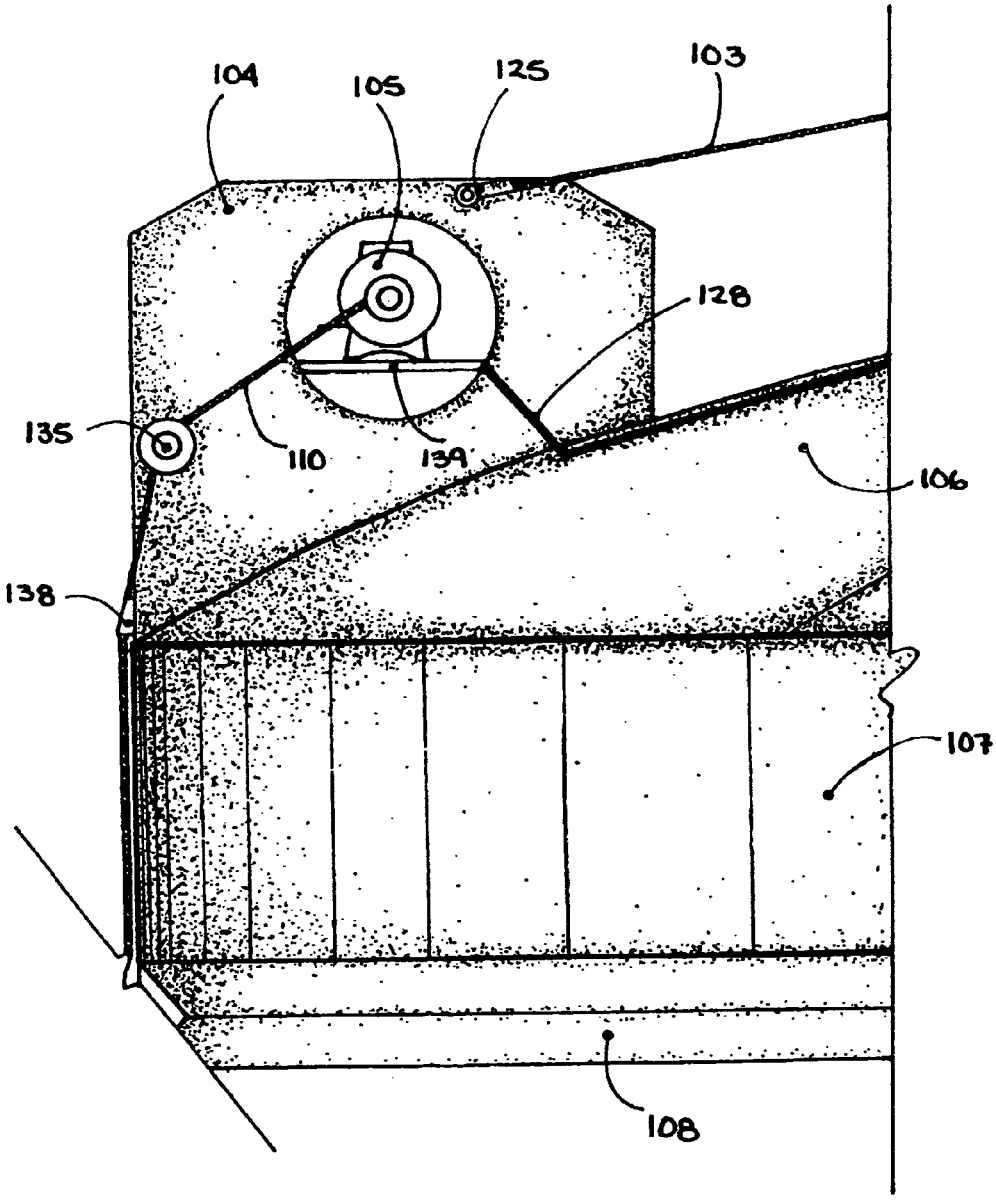
FIG. 14 shows detail of winch motor and cable.
Figure 15:
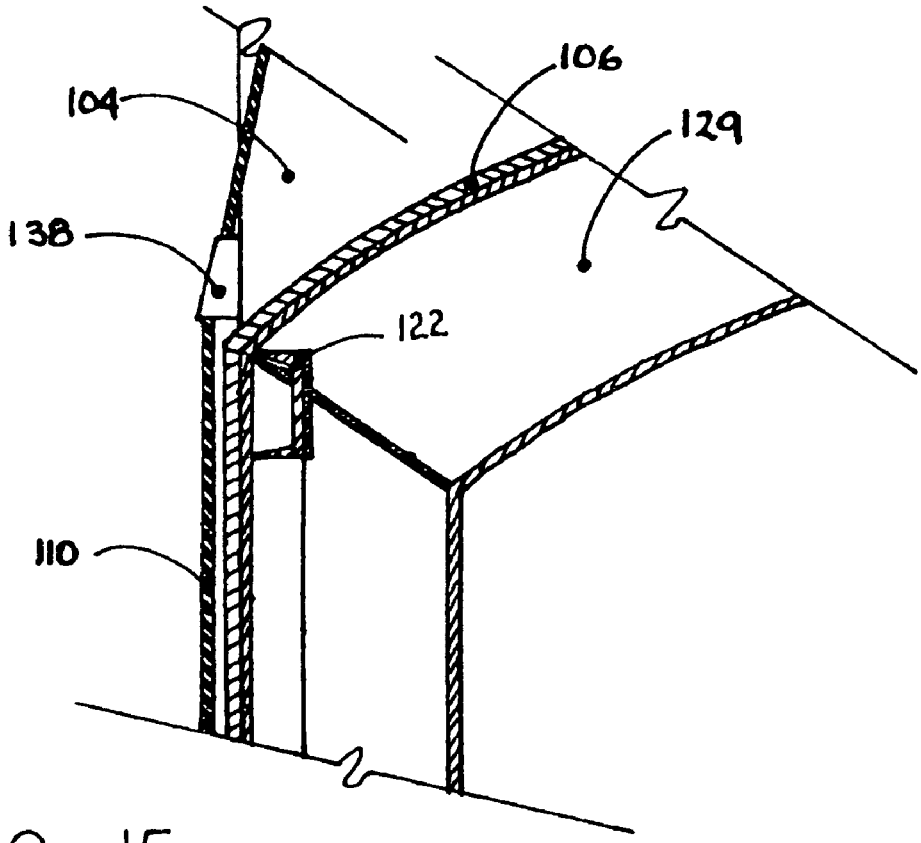
FIG. 15 shows detail of cross section 13-13 at upper truss and primary beam.
Figure 16:
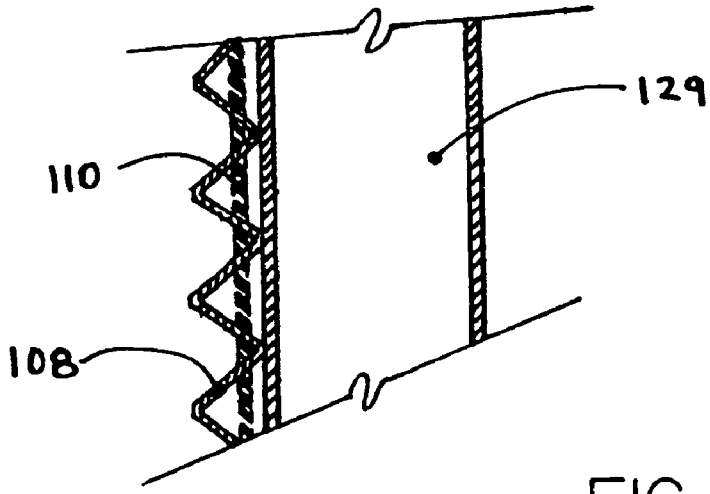
FIG. 16 shows detail of cross section 13-13 at winch cable and outer cover.
Figure 17:
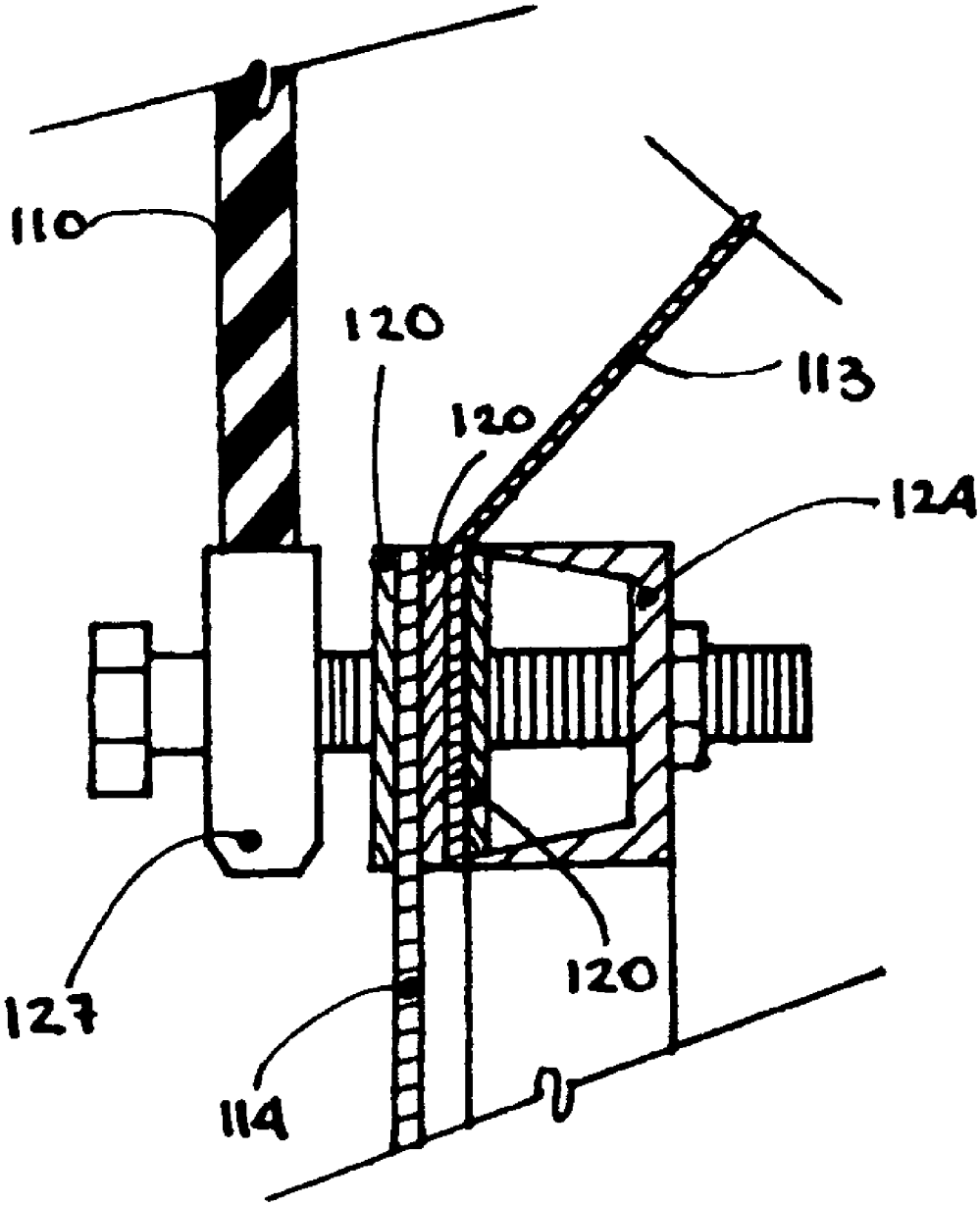
FIG. 17 shows detail of cross section 13-13 at attachment of winch cable to lower circular truss.
Figure 18:
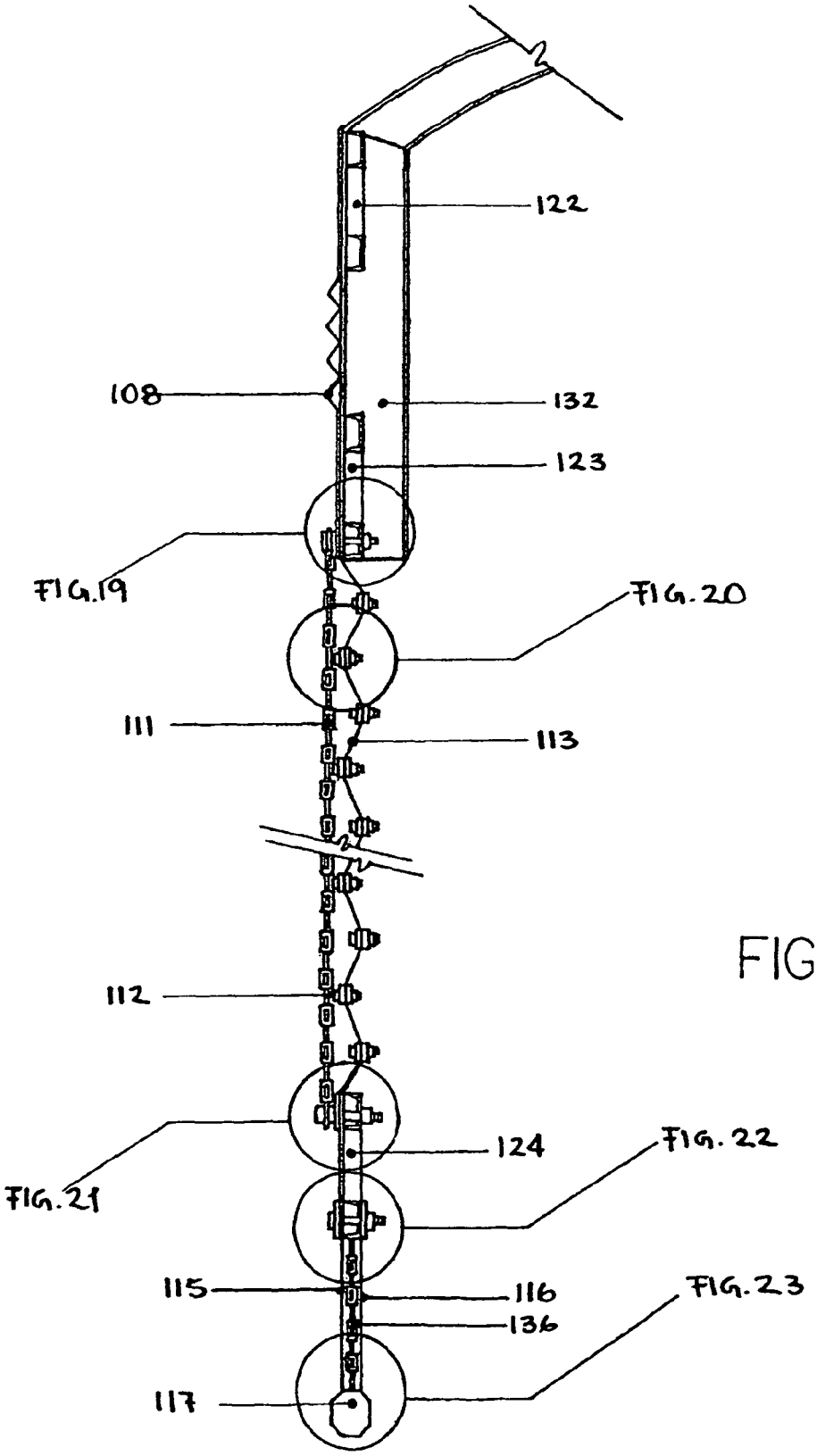
FIG. 18 shows cross section 18-18 at secondary beam and limiting chain.
Figure 19:
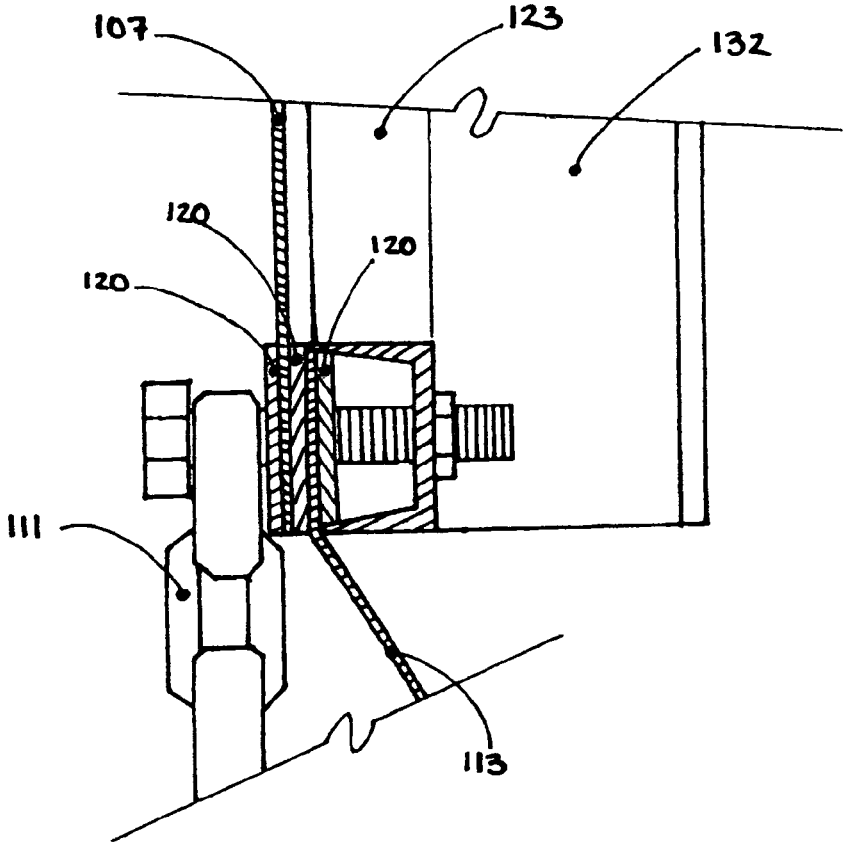
FIG. 19 shows detail of cross section 18-18 at attachment of limiting chain and fabric bellows to middle circular truss.

FIG. 12 is a detail of attachment of the primary beam 129 with the supporting ring 121 by the use of a primary beam vertical connector 134 and the primary beam horizontal support 126. Also shown are the secondary beam horizontal support 131 and a secondary beam vertical connector 130 and the exterior dome panels 106 and the fire proof panels 119.

The collapsing and extending system is illustrated in FIGS. 13, 14, 15, 16, and 17. The extending and collapsing winches 105 are mounted to a winch base 139 and the winch mounting and stabilizing brackets 104. The said extending and collapsing winches 105 are connected to the winch cable 110 which pass through a pulley 135 and a cable guide 138. Said winch cable 110 continues through perforations on the middle outer cover 108 and runs all the way down to the lower circular truss 124 connecting by means of a cable end attachment 127.

FIGS. 18, 19, 20, 21, 22, and 23 illustrate the cross section at the secondary beams 132. To said secondary beams 132 the upper circular truss 122 and the middle circular truss 123. To the circumference of the middle circular truss 123 a plurality of limiting chains 111 are attached. The said limiting chains 111 continue down to the lower circular truss 124.

Figure 20:
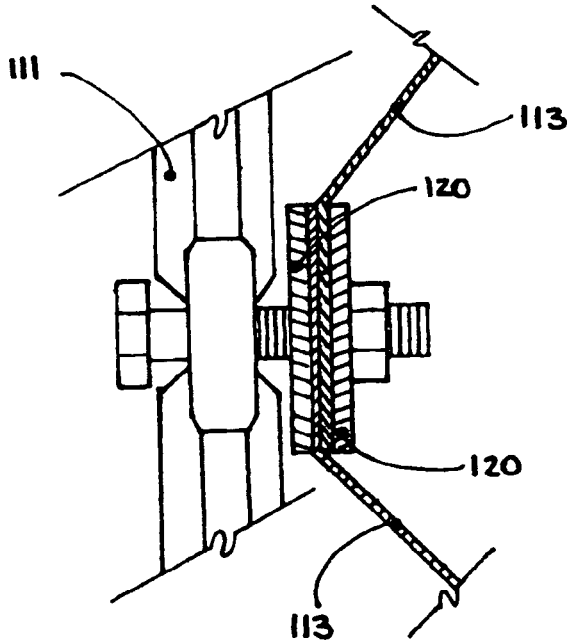
FIG. 20 shows detail of cross section 18-18 at attachment of limiting chain to pivoting unions.
Figure 21:
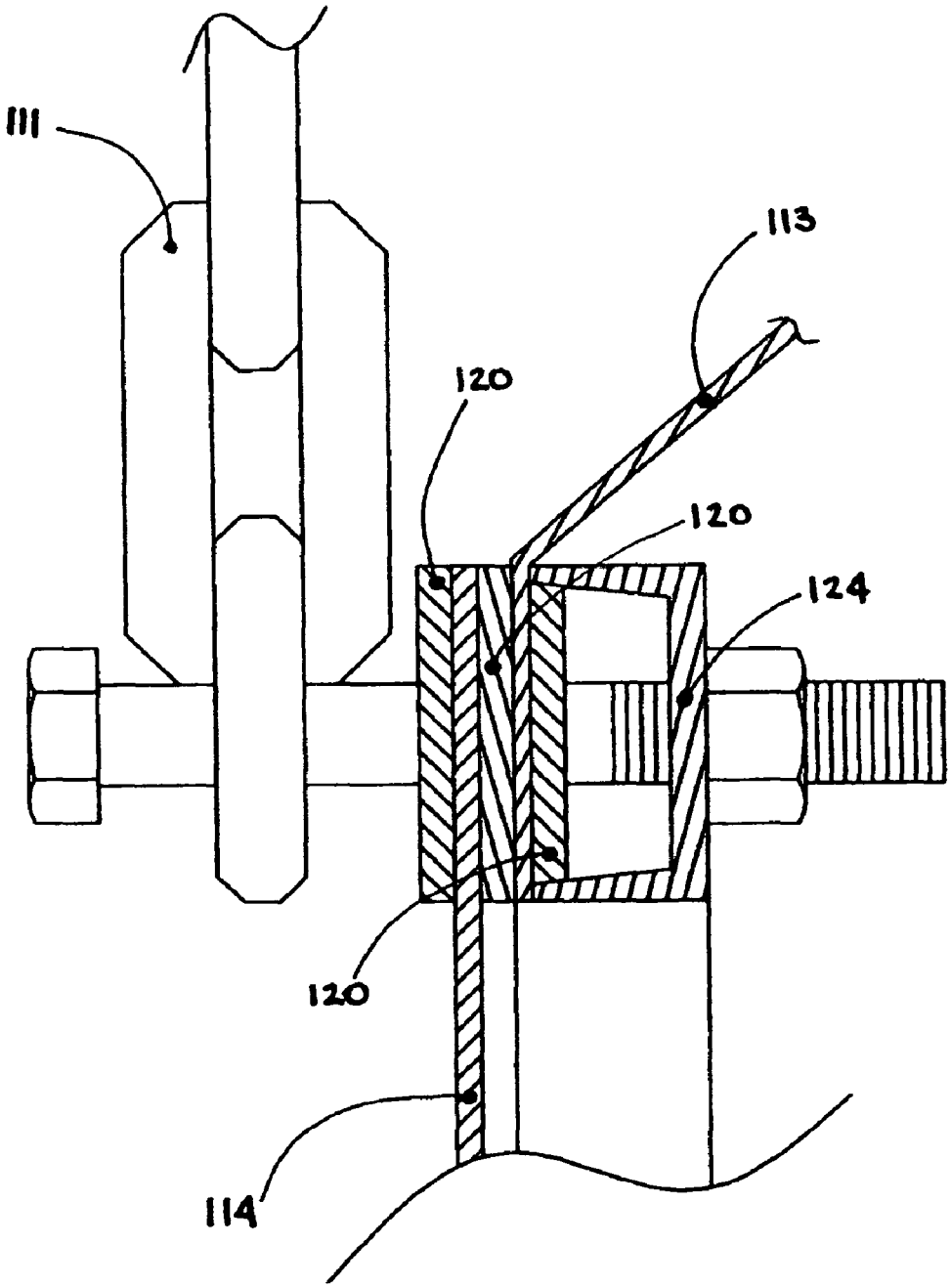
FIG. 21 shows detail of cross section 18-18 at attachment of limiting chains and fabric bellows to lower circular truss.
Figure 22:
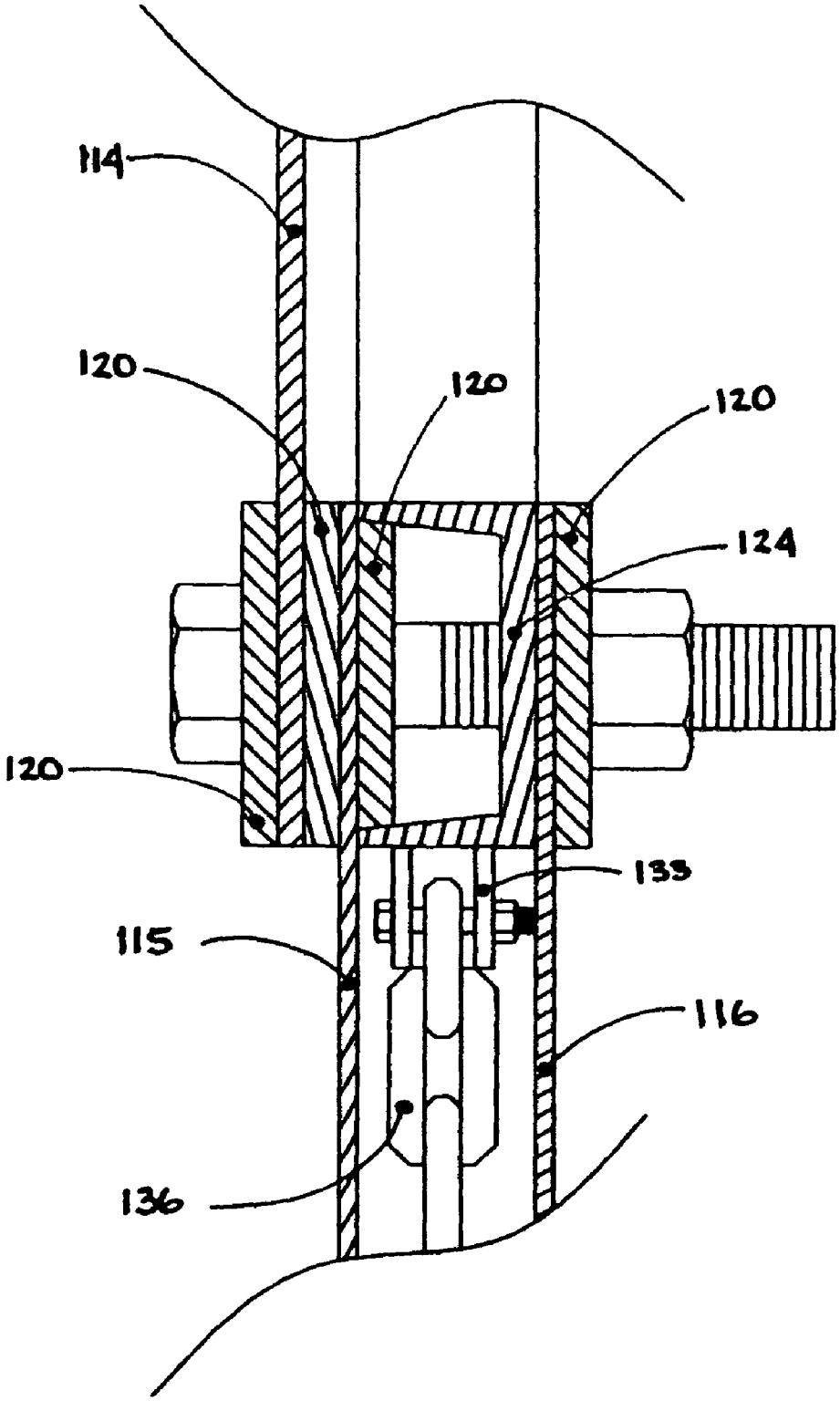
FIG. 22 shows detail of cross section 18-18 at lower circular truss and sealing weight supporting chains.
Figure 23:
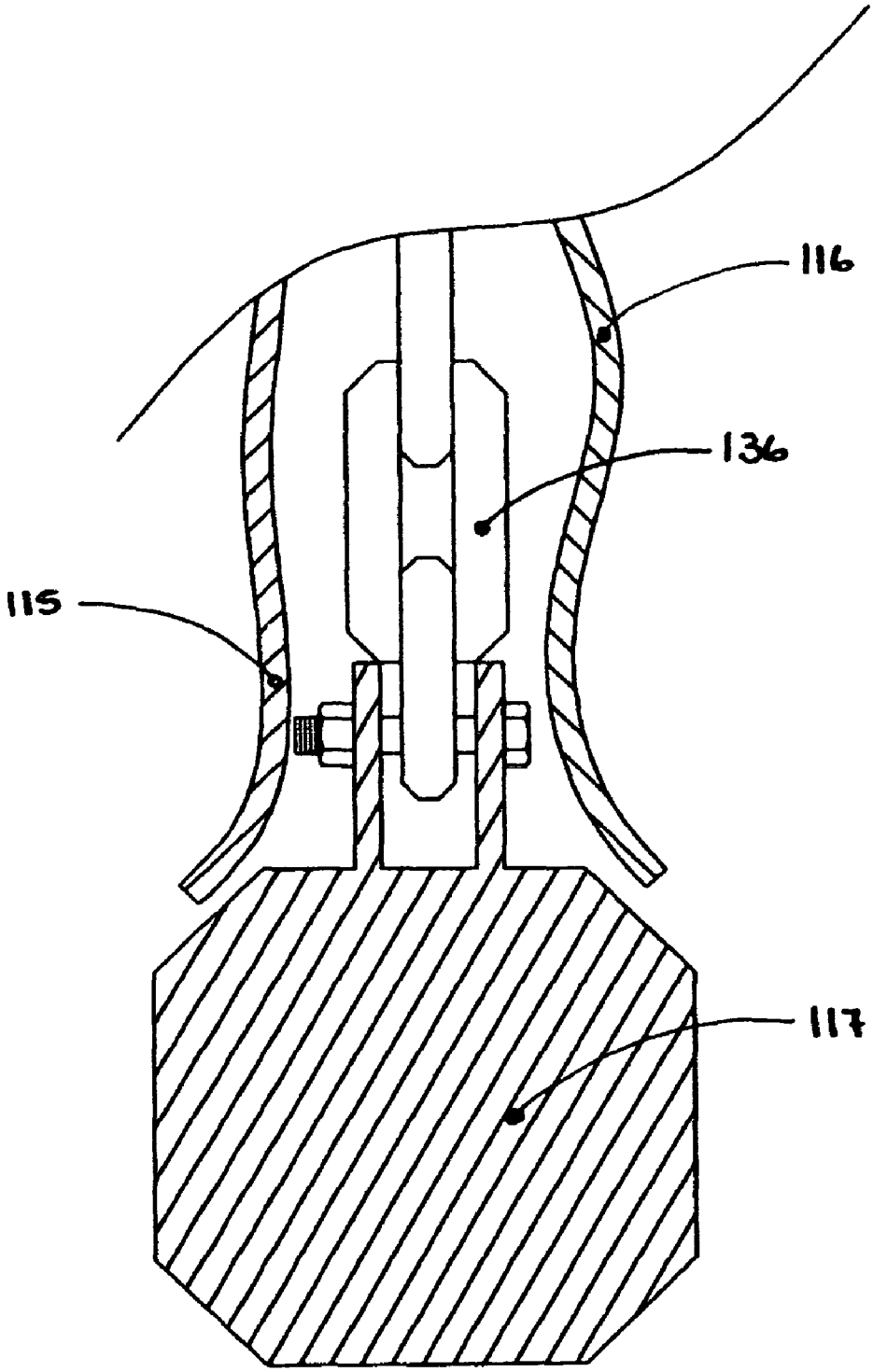
FIG. 23 shows detail of cross section 18-18 at sealing weights.

The fire resistant fabric bellows 113 is attached to the middle circular truss 123, and to the limiting chains 111 at alternating pivoting unions 112 and to the lower circular truss 124. As illustrated in FIG. 20, the pivoting unions are formed by clamping the fire resistant fabric bellows 113 by 2 fabric attaching metal rings 120 and by alternating the perimeter size of the fabric attaching metal rings 120, they give form and allow the fire resistant fabric bellows to extend and collapse.

The said lower circular truss 124 has a chain supporting bracket 133. To said chain supporting bracket 133 a sealing weight supporting chain 136 is attached. The sealing weights 117 are affixed to the said sealing weight supporting chain 136.

Also to the lower circular truss 124, a plurality of outer sealing fabric sections 115 are attached, to cover the sealing weight supporting chain 136 on the outside circumference. And in the same manner, to the said circular truss 124, a plurality of inner sealing fabric sections 116 are attached, to cover the sealing weight supporting chain 136 on the inside circumference.

Operation—FIGS. 1, 2, 3, 13, 18, 23.

The operation of the Combustion Process Stopper (CPS) is as follows. The CPS is hooked to a lifting device 101 and lifted off the ground and is transported in the collapsed position to the fire battle area. Once in the vicinity of the fire, the extending and collapsing winches 105 are activated to extend the embodiment, by releasing the winch cables 110. By releasing the winch cables 110 the lower circular truss 124 is allowed to part from the middle circular truss 109. By separating the lower circular truss 124 and the middle circular truss 109, the fire resistant fabric bellows 113 are extended. The fire resistant fabric bellows 113 are limited from over extending and having to support the lower section of the embodiment by the limiting chains 111, therefore allowing the limiting chains 111 to support the mass of the lower section of the embodiment.

Now that the CPS has been extended, the apparatus is lower on to the burning area attempt to cover as much of the burning area as possible. As the CPS is lowered on to the ground, the sealing weights 117, supported by the sealing weight supporting chains 136, are the first to touch the ground and the outer sealing fabric sections 115 and the inner sealing fabric sections 116 form a seal around the circumference of the embodiment as it continues to be lowered. Once the lower circular truss 124 has reached the ground the fire is completely enclosed in a volume limiting the amount of oxygen present to sustain combustion. The fire resistant fabric bellows 113 may be allowed to contract to further lower the volume enclosed. Once the oxygen has been consumed by the fire, the combustion process will be stopped. After a lapsed time, the CPS can be lifted and move to the next burning area to repeat the process as necessary.

In uneven terrains, the lower section of the embodiment formed by the sealing weight supporting chains 136 and, the flexibility of the outer sealing fabric sections 115 and the inner sealing fabric sections 116, allow for a seal to still be made. Furthermore, the flexibility of the before mentioned lower section in combination with the flexibility of the fire resistant fabric bellows 113, allow for the embodiment to be lowered on to an inclined terrain such as found in mountainous terrain as illustrated in FIG. 3.

Additionally, in small brush fires, the embodiment may be lowered on to the fire without the need to extend the embodiment, allowing for a faster pace of work. Moreover, if high winds are encountered, the embodiment may also be placed in its collapsed position to lower its profile and hence lower its air resistance.

Once the fire has been put out, the embodiment is collapsed and transported back to its base and lower on to the ground.

CONCLUSION, RAMIFICATION, AND SCOPE

As can be read and seen through the illustrations, the combustion process stopper of the various embodiments can be used to put out fires in an efficient manner. Furthermore, the combustion process stopper has the additional advantages in that

- it permits the combustion process stopper to be produced in a variety of sizes to allow the extinguishing of different types of fires;
- it provides for a mechanical means of fighting fires;
- it permits a continuous fire fighting method with out having to stop to recharge for water or chemical repellent;
- it uses a small team of operators;
- it can adapt to the inclination or irregularity of the terrain being used;
- it provides for a seal to be formed with the ground;
- it adjusts in size to accommodate different size of burning material;
- it requires little maintenance;
- it can be a first response apparatus to combat fires.

Although the description above contains many specifities, these should no be construed as limiting the scope of the embodiment but as merely providing illustrations of some of the presently preferred embodiments. For example, the combustion process stopper can be constructed with longer bellows to allow it to become taller and accommodate taller trees; the embodiment does not have to be circular and can be made in other shapes.

Thus the scope of the embodiment should be determined by the appended claims and their legal equivalents, rather than by the examples given.

I claim:

1. A fire extinguishing apparatus that encapsulates the fire with the purpose of preventing the supply of oxygen required in the combustion process, hence starving said fire of oxygen until it is suffocated, and is comprised of a cylindrical flexible assembly made of a flexible element with the purpose of being either contracted or elongated and adapt to the size of the fire, and allowing a ring with sealing elements to conform to the inclination and contours of any surface it rests upon.

2. A fire extinguishing apparatus that encapsulates the fire with the purpose of preventing the supply of oxygen required in the combustion process, hence starving said fire of oxygen until it is suffocated, and is comprised of a ring composed of sealing elements that is attached to a cylindrical flexible assembly suspended from a rigid semi hemispherical assembly through cables, with the purpose of attracting and repelling the said ring composed of sealing elements to the aforementioned semi hemispheric assembly allowing the combined assembly to contract and to expand.

* * * * *